US011015863B2

(12) United States Patent
Park et al.

(10) Patent No.: US 11,015,863 B2
(45) **Date of Patent: *May 25, 2021**

(54) REFRIGERATOR

(71) Applicant: LG Electronics Inc., Seoul (KR)

(72) Inventors: Kihyun Park, Seoul (KR); Seongjin Na, Seoul (KR); Daehyun Yoo, Seoul (KR); Kiyoung Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/733,014

(22) Filed: Jan. 2, 2020

(65) Prior Publication Data

US 2020/0141632 A1 May 7, 2020

Related U.S. Application Data

(63) Continuation of application No. 16/198,043, filed on Nov. 21, 2018, now Pat. No. 10,557,663.

(30) Foreign Application Priority Data

Nov. 22, 2017 (KR) ..... 10-2017-0156555

(51) Int. Cl.

| | |
|---|---|
| ***F25D 25/02*** | (2006.01) |
| ***A47B 96/16*** | (2006.01) |
| ***A47B 88/919*** | (2017.01) |
| ***A47B 88/417*** | (2017.01) |
| ***A47B 88/90*** | (2017.01) |

(52) U.S. Cl.

CPC ..... *F25D 25/025* (2013.01); *A47B 88/919* (2017.01); *A47B 96/16* (2013.01); *A47B 88/417* (2017.01); *A47B 88/90* (2017.01)

(58) Field of Classification Search

CPC ..... F25D 23/02; F25D 23/028; F25D 23/021; A47B 96/16; A47B 88/90

See application file for complete search history.

(56) References Cited

U.S. PATENT DOCUMENTS

| | | | | |
|---|---|---|---|---|
| 10,161,672 | B2 * | 12/2018 | Cizik | F25D 25/025 |
| 10,557,663 | B2 * | 2/2020 | Park | A47B 96/16 |
| 2013/0264928 | A1 * | 10/2013 | Hong | F25D 23/028 312/404 |
| 2016/0174713 | A1 * | 6/2016 | Dubina | A47B 88/40 312/334.8 |
| 2017/0010039 | A1 * | 1/2017 | Hong | F25D 25/005 |
| 2018/0100686 | A1 * | 4/2018 | Cizik | F25D 25/005 |
| 2018/0100689 | A1 * | 4/2018 | Gatter | F25D 25/005 |
| 2019/0041123 | A1 * | 2/2019 | Lee | A47B 88/48 |
| 2019/0049171 | A1 * | 2/2019 | Yao | F25D 25/025 |

* cited by examiner

*Primary Examiner* — Daniel J Rohrhoff

(74) *Attorney, Agent, or Firm* — Fish & Richardson P.C.

(57) ABSTRACT

A refrigerator comprises: a cabinet having a storage chamber; a door to open and close the storage chamber; a drawer assembly connected to the door and having a drawer; a rail assembly to connect the drawer assembly to the cabinet; and a weight balance positioned in the drawer assembly and opposite the door.

20 Claims, 13 Drawing Sheets

REFRIGERATOR

CROSS-REFERENCE TO RELATED APPLICATION

This application is a continuation of U.S. application Ser. No. 16/198,043, filed on Nov. 21, 2018, which claims the benefit of priority to Korean Patent Application No. 10-2017-0156555, filed on Nov. 22, 2017, in the Korean Intellectual Property Office. The disclosures of the prior applications are incorporated by reference in their entirety.

BACKGROUND

1. Technical Field

The present disclosure relates to a refrigerator.

2. Description of the Related Art

Generally, a refrigerator is a household appliance that can store objects, such as food, in a low-temperature state in the storage chamber of a cabinet. Because the storage chamber is enclosed by an insulating wall, the interior of the storage chamber may be maintained at a temperature lower than the external temperature.

Depending on the temperature zone of the storage chamber, the storage chamber may be divided into a refrigerating chamber or freezing chamber. The user may store the food in the freezing room or the refrigerating room depending on the type and condition of the food.

The refrigerator may be provided in a built-in type together with other appliances in the kitchen. In this case, the appearance design of the refrigerator is configured to match the kitchen furniture.

In recent years, depending on the various needs of the user, the refrigerator is placed in a living room or a room, not a kitchen. In other words, the installation position of the refrigerator is various.

As the location of the refrigerator varies, the appearance of the refrigerator is configured so that the appearance of the refrigerator goes well with the furniture in the space to install the refrigerator.

Prior Art Document 1

Korean Patent No. 10-1323876 discloses a cooling package with a thermoelectric element, and a refrigerator employing the same.

The refrigerator of the prior art document 1 includes a refrigerator body in which a refrigerating chamber is formed; a door that is rotatably installed on the refrigerator body to open and close the refrigerator compartment; a cooling package coupled to a body coupling opening and having a thermoelectric element; and endothermic unit coupled to a leading end of the cooling packaging in the refrigerating chamber; and a heat-dissipation unit coupled to a rear end of the cooling packaging at a rear side of the refrigerator body; and a drain pipe for draining condensed water generated in the refrigerating chamber to the heat-dissipation unit using a capillary phenomenon.

In the case of the prior art document 1, when the cooling packaging having the thermoelectric element is used, there is an advantage in that the size of a refrigerator can be reduced, but a technique for allowing a user to easily draw a drawer assembly is not disclosed.

Prior Art Document 2

Korean Laid-open Patent Application No. 10-2006-0022426 discloses a double drawer of a refrigerator.

The refrigerator of the prior art document 2 includes a drawer chamber disposed on the lower side of the refrigerating chamber and a drawer-type door for shielding the inside of the drawer chamber.

The drawer-type door is coupled to the lower end of the storage box via a hinge, and the storage box moves in a slide manner in the front-rear direction and mounted onto a three-stage rail extending in a multi-stage manner. Further, the storage box and the drawer door are pulled out or drawn out together by the user pushing or pulling a handle formed at a top of the drawer door.

According to the prior art document 2, the storage box together the door may be taken out of the drawer room when the drawer-type door is opened.

However, when the structure of the drawer type door and the storage box having the same structure as the prior art document 2 is applied to the small refrigerator as in the prior art document 1, there is a problem as follows:

First, when the drawer door is opened while food is being stored in the storage box, the total weight of the food contained in the drawer door, the storage box, and the drawer door may be heavier than the weight of the refrigerator body. Thus, during the opening of the drawer door, the refrigerator may tilt forwards or the drawer door may hit a floor on which the refrigerator is disposed.

In addition, in the case of the prior art document 2, the three-stage rail is mounted on the side face of the storage box, and the rail is exposed to the outside in the process of the storage box being pulled out of the drawer chamber. Thus, there is a problem that a sense of beauty is deteriorated.

In addition, in the case of the prior art document 2, the storage box is hinge-coupled to the lower end of the drawer type door, so that it is not easy to separate the storage box from the drawer door. Further, when the storage box is connected to the drawer door, cleaning of the refrigerator is difficult.

SUMMARY

The present embodiment provides a refrigerator that allows a door to open stably during the door together with a drawer assembly are drawn out.

In addition, the present embodiment provides a refrigerator in which the refrigerator is prevented from tilting forward or the door is prevented from colliding against a floor during drawer assembly withdrawal.

In addition, the present embodiment provides a refrigerator capable of separating the drawer while the drawer assembly is being drawn out.

In addition, the present embodiment provides a refrigerator in which exposure of the rail to the outside is minimized during the drawer assembly draw-out.

In one aspect, a refrigerator may include a cabinet having a storage chamber; a door to open and close the storage chamber; a drawer assembly connected to the door and having a drawer; a rail assembly to connect the drawer assembly to the cabinet; and a weight balance positioned in the drawer assembly and opposite the door.

DETAILED DESCRIPTIONS

Figure 1:
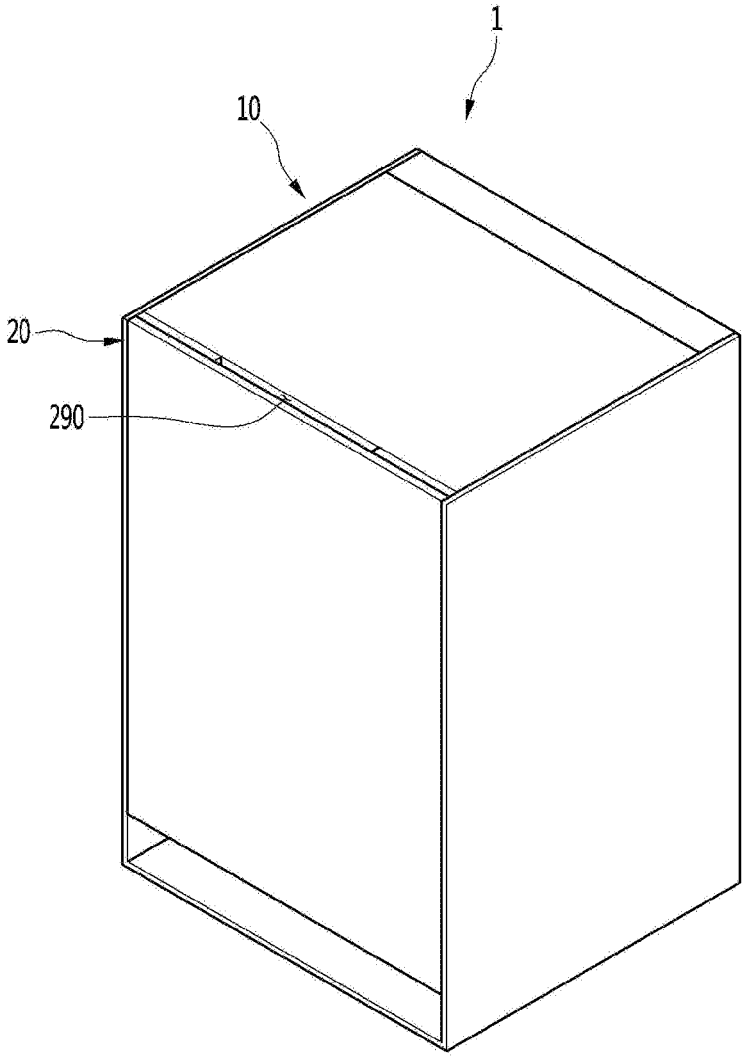
FIG. 1 is a perspective view of a refrigerator according to one embodiment of the present disclosure.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
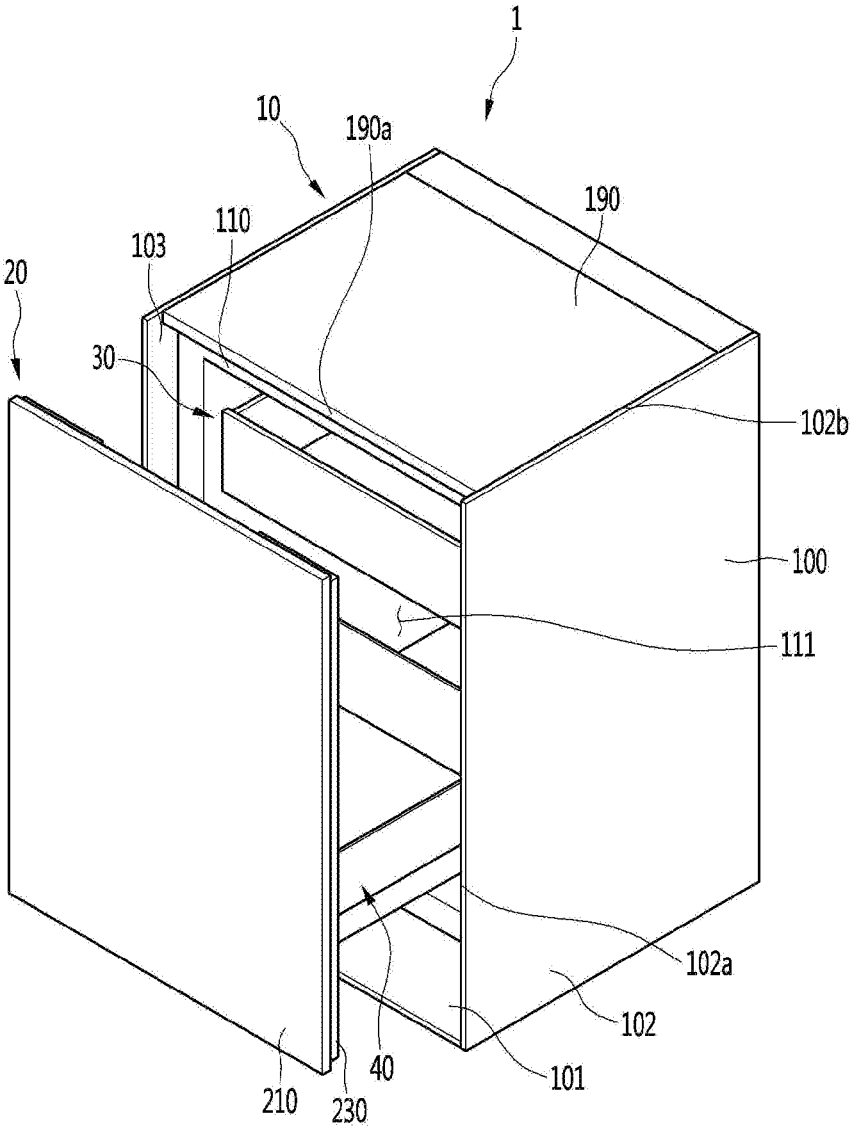
FIG. 2 is a perspective view showing a door being opened in FIG. 1.
Figure 3:
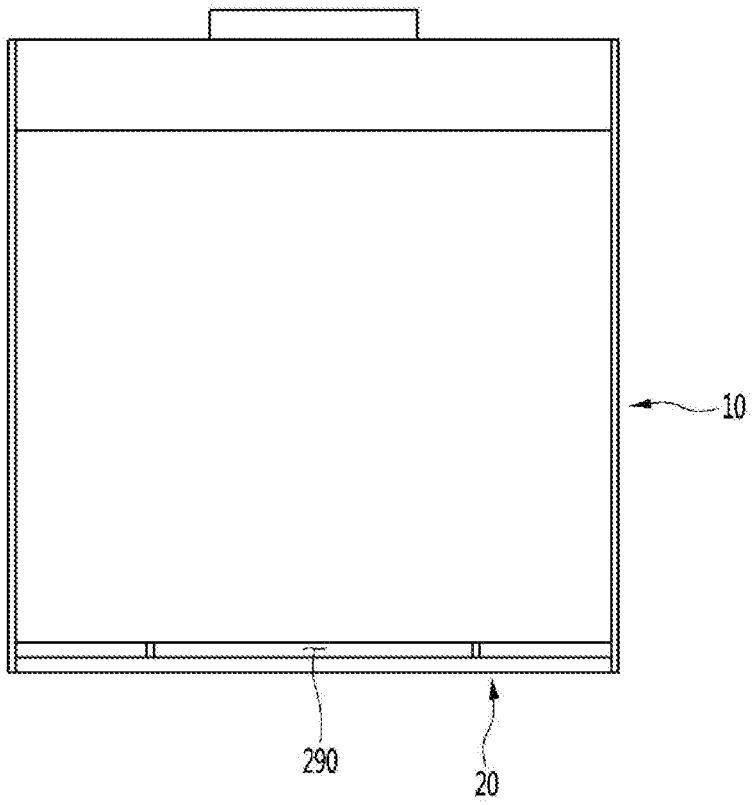
FIG. 3 is a plan view of the refrigerator of FIG. 1.
Figure 4:
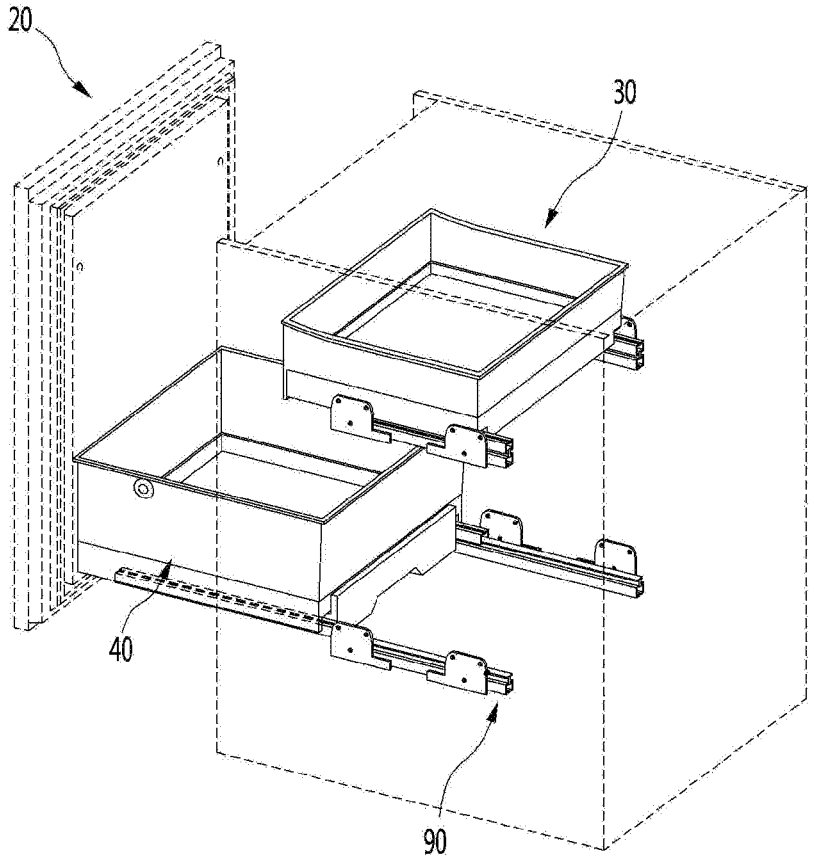
FIG. 4 is a rear perspective view of the refrigerator showing a door being pulled out together with a lower drawer assembly.

FIG. 1 is a perspective view of a refrigerator according to one embodiment of the present disclosure. FIG. 2 is a perspective view showing a door being opened in FIG. 1. FIG. 3 is a plan view of the refrigerator of FIG. 1. FIG. 4 is a rear perspective view of the refrigerator showing a door being pulled out together with a lower drawer assembly.

Referring to FIGS. 1 to 4, a refrigerator 1 according to one embodiment of the present disclosure may include a cabinet 10 having a storage chamber 111, a door 20, which opens and closes the storage chamber 111, and connected to the cabinet 10.

The cabinet 10 may include the inner casing 110 forming the storage chamber 111, and an outer casing 100 surrounding the inner casing 110.

The outer casing 100 may be formed of a metal material. For example, the outer casing 100 may be formed of aluminum Al. The outer casing 100 may be formed by bending a plate at least twice. Alternatively, the outer casing 100 may be formed by joining a plurality of metal plates.

In one example, the outer casing 100 may include a pair of side panels 102 and 103.

The inner casing 110 may be directly or indirectly fixed to the outer casing 100 with the inner casing 110 being positioned between the pair of side panels 102 and 103.

A front end 102*a* of each of the pair of side panels 102 and 103 may be located more forwards than the front surface of the inner casing 110. The horizontal width of the door 20 may be equal to or less than the distance between the side panels 102 and 103.

Thus, a space in which the door 20 may be located may be defined between the pair of side panels 102 and 103.

In one example, the door 20 may be located between the pair of side panels 102 and 103 with the storage chamber 111 being closed by the door.

In this connection, the front surface of the door 20 may be coplanar with a front end 102*a* of each of the side panels 102 and 103 such that a step between the door 20 and the cabinet 10 may not occur when the storage chamber 111 is closed by the door.

That is, the front surface of the door 20 and a front end 102*a* of each of the side panels 102 and 103 may together define the appearance of the front surface of the refrigerator 1.

The door 20 may include a front panel 210 and a door liner 230 coupled to a rear surface of the front panel 210.

The front panel 210 may be formed of a wood material. However, the present disclosure is not limited thereto.

In one example, the front panel 210 and the door liner 230 may be engaged with each other by fasteners such as screws. The front panel 210 and the door liner 230 form a foam space therebetween. When the foam liquid is filled in the foam space, a thermal-insulating material may be formed between the front panel 210 and the door liner 230.

The door 20 may have a gripping space 290 in which a user's hand may be inserted so that the user can catch the door 20 to open the door 20.

In one example, the gripping space 290 may be formed by partially recessing an upper portion of the door liner 230 downwardly.

While the door 20 closes the storage chamber 111, the gripping space 290 may be located between the front panel 210 and the cabinet 10. Thus, while the door 20 closes the storage chamber 111, the user may open the door 20 by inserting a hand into the gripping space 290 and then pulling the door 20.

In the present embodiment, since while the door 20 is closed, a structure such as a handle does not protrude outward, there is an advantage that the beauty of refrigerator 1 is improved.

The height of the refrigerator 1 may be lower than a typical adult height. The present disclosure may not be limited thereto. The lower the capacity of the refrigerator 1, the lower the height of the refrigerator 1.

As in the present embodiment, when there is a gripping space 290 within the top of the door 20, the following advantage is achieved: Even though the height of the refrigerator 1 is low, the user can easily open the door 20 while the user is standing or sitting.

In one embodiment, the top end 102*b* of each of the pair of side panels 102 and 103 may be higher than the top of the inner casing 110.

Therefore, a space may be formed above the inner casing 110. A cabinet cover 190 may be located in the space. The cabinet cover 190 may form a top appearance of the cabinet 10. That is, the cabinet cover 190 forms a top appearance of the refrigerator 1.

The cabinet cover 190 may be secured directly to the inner casing 110 or to the middle plate 150 surrounding the inner casing 110.

While the cabinet cover 190 covers the inner casing 110, the cabinet cover 190 may be located between the pair of side panels 102 and 103.

In one embodiment, in order to avoid a step between the cabinet cover 190 and the cabinet 10, a top surface of the cabinet cover 190 may be located on the same plane or the same height as the top end 102*b* of each of the side panels 102 and 103.

In one example, the cabinet cover 190 may be formed of wood material. The present disclosure is not so limited.

That is, the front panel 210 and the cabinet cover 190 may be formed of the same material.

In the present embodiment, the front panel 210 of the door 20 and the cabinet cover 190 are both formed of a wood material. Thus, there is an advantage that the aesthetics can be improved due to the material identity between the door 20 and the cabinet cover 190 while the door 20 is closed.

Further, when the height of the refrigerator 1 is low, the user can visually check the cabinet cover 190. In this connection, since the cabinet cover 190 is made of the wood material, this has the advantage of not only improving the basic aesthetics but also achieving aesthetic harmony with the surrounding furniture where the refrigerator 1 is positioned.

In one example, the refrigerator 1 of the present embodiment may be implemented as a refrigerator that can be used as a table (hereinafter, a table type refrigerator).

A refrigerator that can be used as a table may also serve as a table function in addition to the storage function of foods. Unlike conventional refrigerators, which are often found in the kitchen, a refrigerator, which can be used as a table, may be placed next to the bedroom bed and may be used. In the present embodiment, since the cabinet cover 190 and the front panel 210 are formed of wood material, the appearance of the refrigerator may be in harmony with the surrounding furniture when the refrigerator 1 is placed next to the bedroom.

In one example, for the convenience of the user, the height of the table type refrigerator is preferably similar to the height of the bed. The height of the table type refrigerator may be smaller than the height of a conventional refrigerator and thus the refrigerator may be formed compactly.

A front surface 190*a* of the cabinet cover 190 may be located more forwards than the front surface of the inner casing 110. Thus, while the door 20 closes the storage chamber 111, the cabinet cover 190 may cover a portion of the door liner 230 from above.

The refrigerator 1 may further include one or more drawer assemblies 30 and 40 received in the storage chamber 111.

A plurality of drawer assemblies 30 and 40 may be provided in the storage chamber 111 for efficient storage space.

The multiple drawer assemblies 30 and 40 may include upper drawer assembly 30 and lower drawer assembly 40. In some cases, the upper drawer assembly 30 may be omitted.

The door 20 may open and close the storage chamber 111 while sliding in a forward and backward direction.

In the present embodiment, even when the refrigerator 1 is placed in a narrow space such as a kitchen, living room, or room, the user has the advantage that the door 20 can be opened without interfering with the surrounding structure since the door 20 opens and closes the storage chamber 111 in the sliding manner.

In order that the door 20 is slid in and out, the refrigerator 1 may also include a rail assembly 90.

The rail assembly 90 may be connected to the door 20 on one side of the rail assembly, and to the lower drawer assembly 40 on the other side of the rail assembly.

Thus, since the door 20 is connected to the lower drawer assembly 40, and the lower drawer assembly 40 is connected to the rail assembly 90, the lower drawer assembly 40 may be withdrawn out of the storage chamber 111 by the rail assembly 90 in the process of opening the door 20.

The upper drawer assembly 30 may be manually pulled out of the storage chamber 111 by a user or manually inserted into the storage chamber 111 by the user. Alternatively, the upper drawer assembly 30 may be withdrawn out in a sliding manner together with the door 20 at an initial opening time during the opening of the door 20. The upper drawer assembly 30 may be configured to be stopped at a position where it has been drawn out at a predetermined distance. To this end, one or more of the upper drawer assembly 30 and the door 20 may be provided with magnets.

<Structure of Cabinet>

Figure 5:
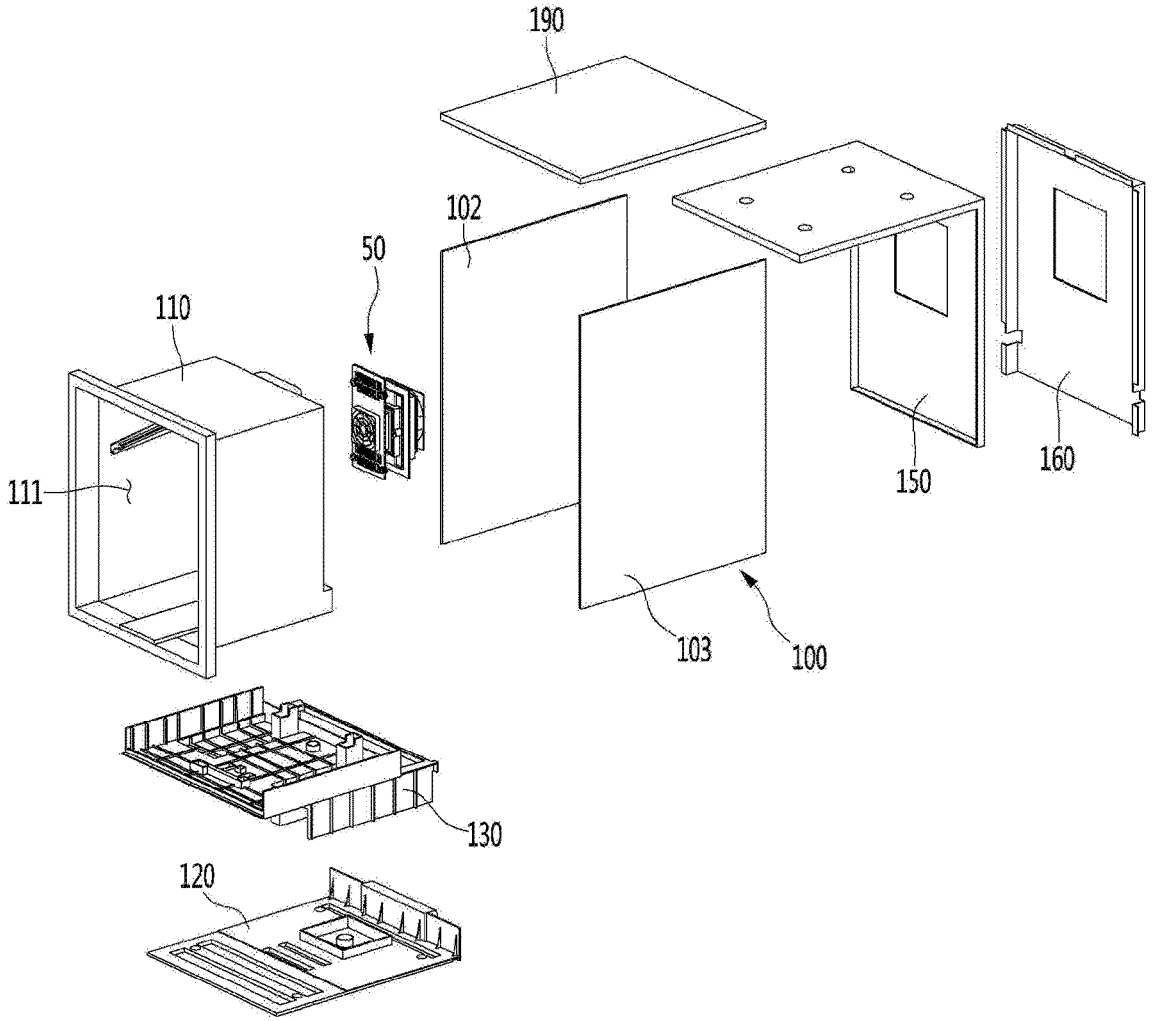
FIG. 5 is an exploded perspective view of a cabinet according to one embodiment of the present disclosure.

FIG. 5 is an exploded perspective view of a cabinet according to one embodiment of the present disclosure.

Referring to FIGS. 1 to 5, a cabinet 10 according to one embodiment of the present disclosure may include an outer casing 100, an inner casing 110, and a cabinet cover 190.

The outer casing 100 may include a pair of side panels 102 and 103. The pair of side panels 102, 102 may form the side appearance of the refrigerator 1.

The outer casing 100 may further include a rear panel 160 that forms the rear surface appearance of the refrigerator 1.

Thus, the appearance of the refrigerator 1 except the door 20 may be formed by the side panels 102 and 103, the cabinet cover 190 and the rear panel 160.

The cabinet 10 may further include a casing supporter 130 supporting the inner casing 110 and a base 120 coupled to the bottom of the casing supporter 130.

The cabinet 10 may also include a middle plate 150. The middle plate, together with the inner casing 110, forms a foam space. The middle plate 150 may cover the top and rear surfaces of the inner casing 110 at a spaced apart position from the inner casing 110.

A display unit 140 may be coupled to at least one of the middle plate 150 and the side panels 102 and 103.

The cabinet 10 may further include a cooling device 50 for cooling the storage chamber 111. The cooling device 50 may include a thermoelectric module (not shown). The adoption of thermoelectric elements may reduce the size of the refrigerator.

Figure 6:
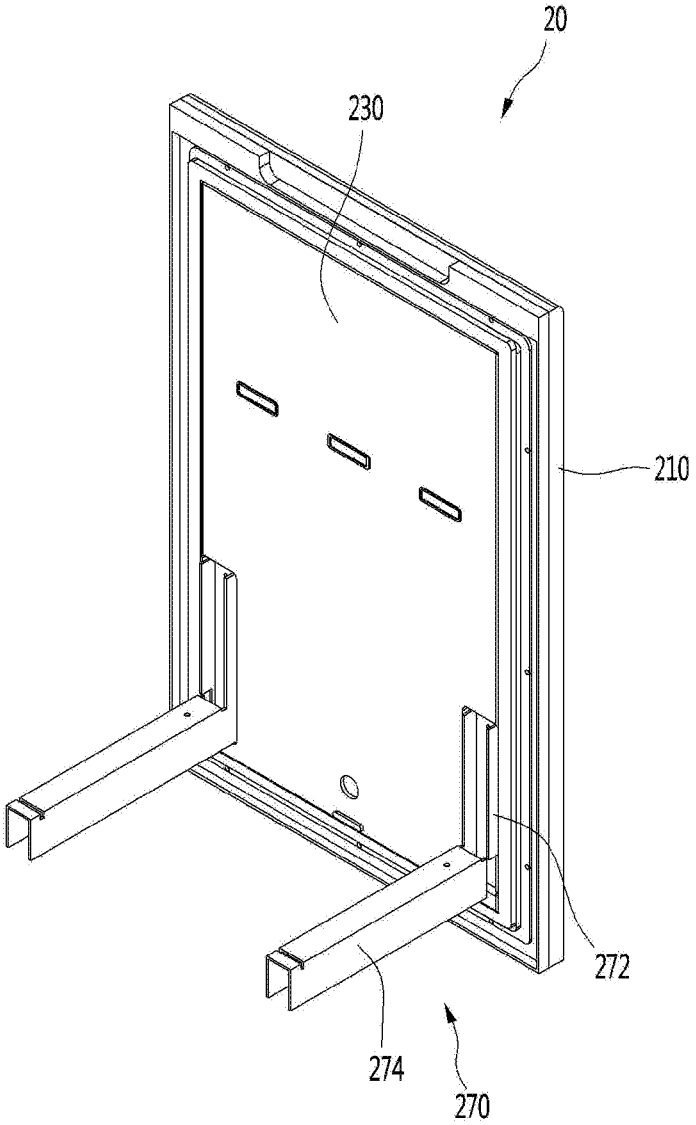
FIG. 6 is a view showing a door bracket being installed on a rear surface of the door according to one embodiment of the present disclosure.

FIG. 6 shows a door bracket being installed on the rear surface of the door according to one embodiment of the present disclosure.

Referring to FIG. 6, one or more door frames 270 may be coupled to the rear surface of the door 20.

The one or more door frames 270 may support the lower drawer assembly 40. The plurality of door frames 270 may be coupled to a door liner 230 in a state in which they are, in a horizontal direction, spaced apart from each other, for stable support of the lower drawer assembly 40.

The door frame 270 may include a horizontal frame 272 extending in the front-rear direction and a vertical frame 274 extending upwardly from a front end of the horizontal frame 272. The vertical frame 274 may be coupled to the door liner 230, while the horizontal frame 272 may be coupled to the lower drawer assembly 40.

<Lower Drawer Assembly>

Figure 7:
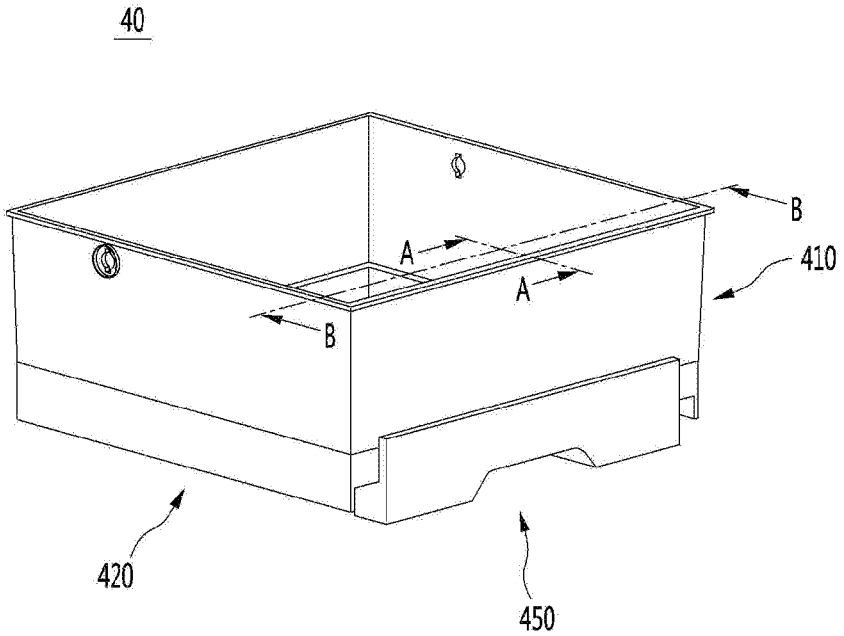
FIG. 7 is a perspective view of a lower drawer assembly according to one embodiment of the present disclosure.
Figure 8:
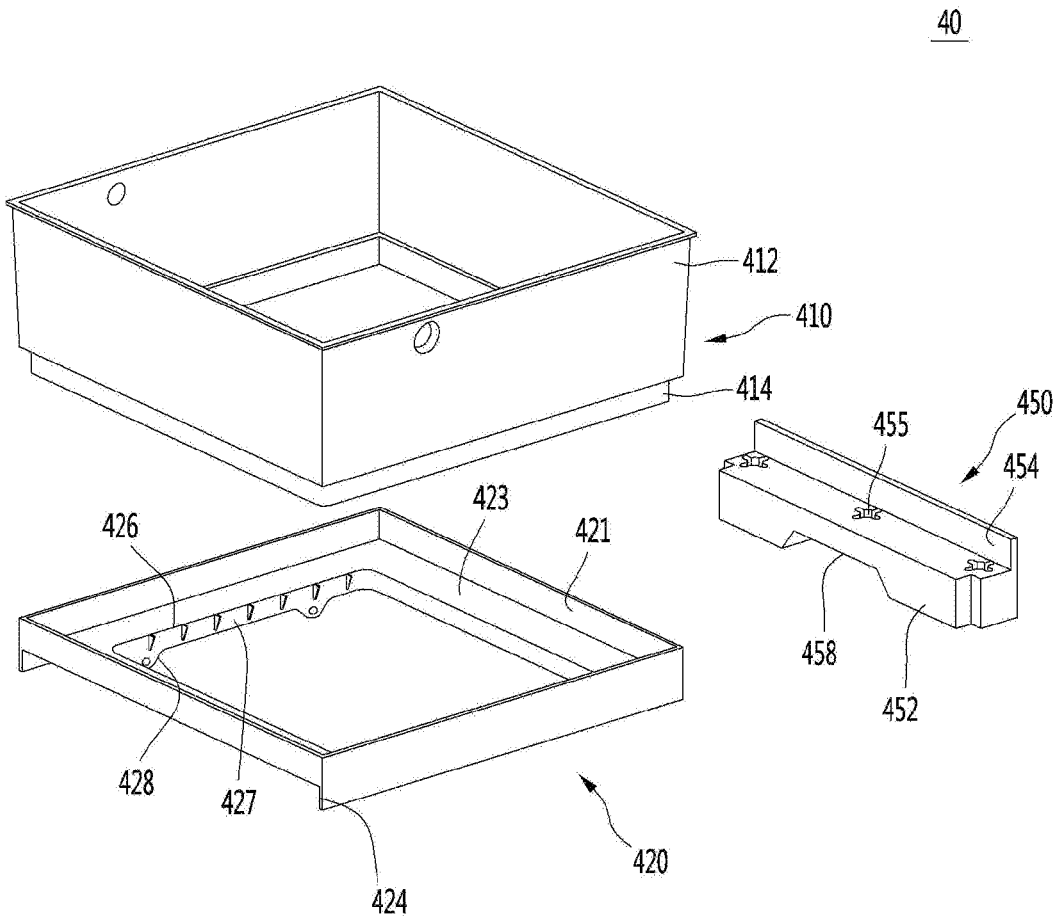
FIG. 8 and FIG. 9 are exploded perspective views of the lower drawer assembly according to one embodiment of the present disclosure.
Figure 9:
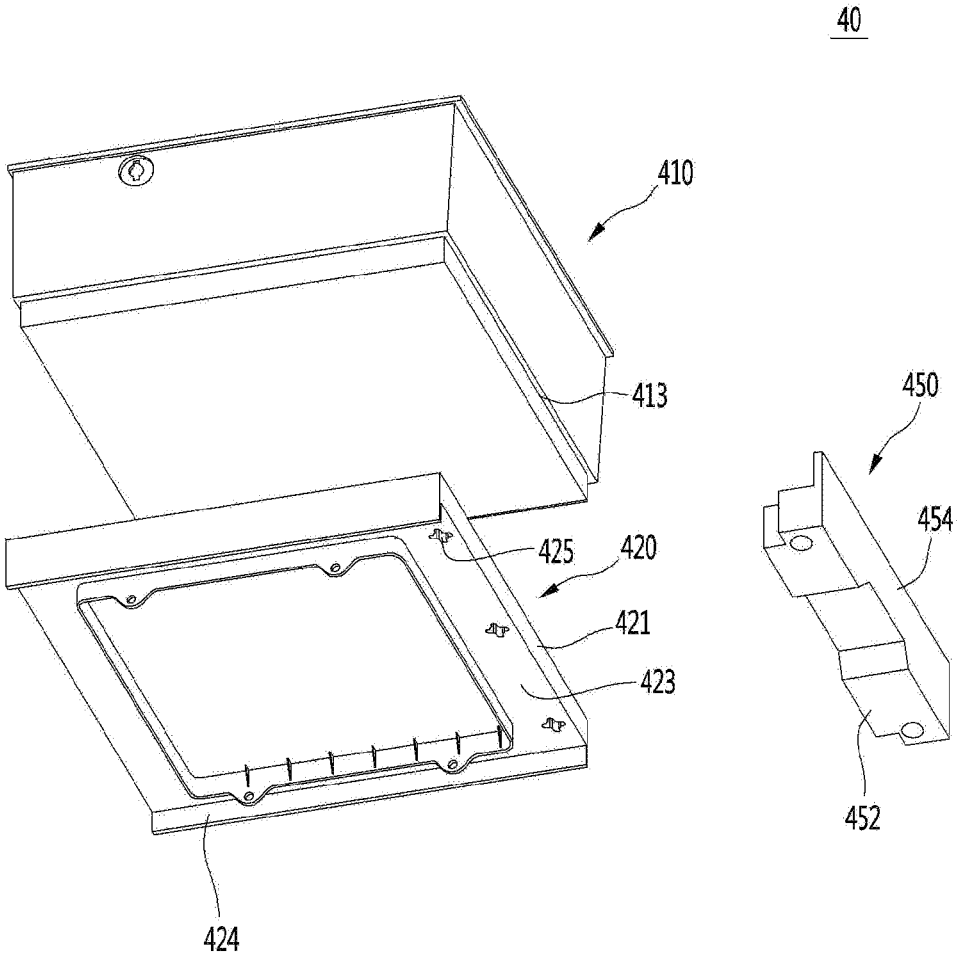
Figure 10:
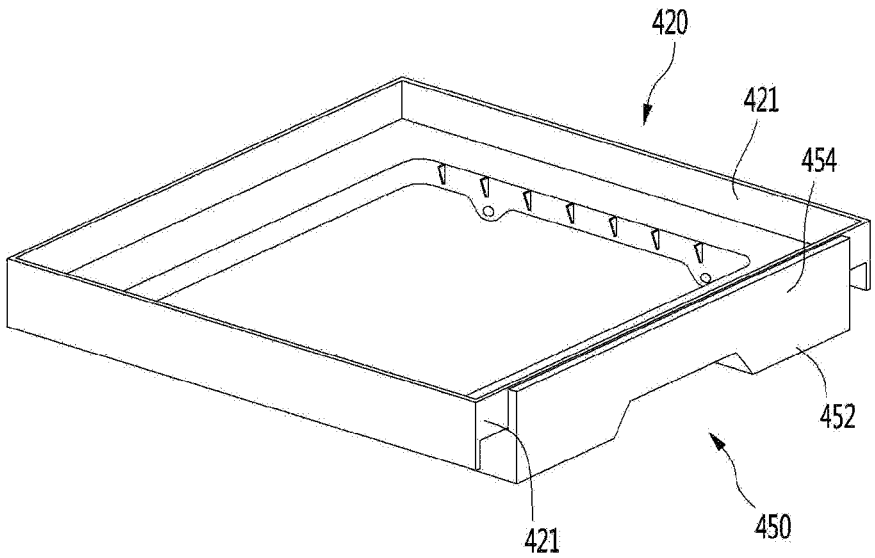
FIG. 10 is a perspective view showing a weight balance coupled to a drawer supporter according to one embodiment of the present disclosure.

FIG. 7 is a perspective view of a lower drawer assembly according to one embodiment of the present disclosure. FIG. 8 and FIG. 9 are exploded perspective views of the lower drawer assembly according to one embodiment of the present disclosure. FIG. 10 is a perspective view showing a weight balance coupled to a drawer supporter according to one embodiment of the present disclosure.

Figure 11:
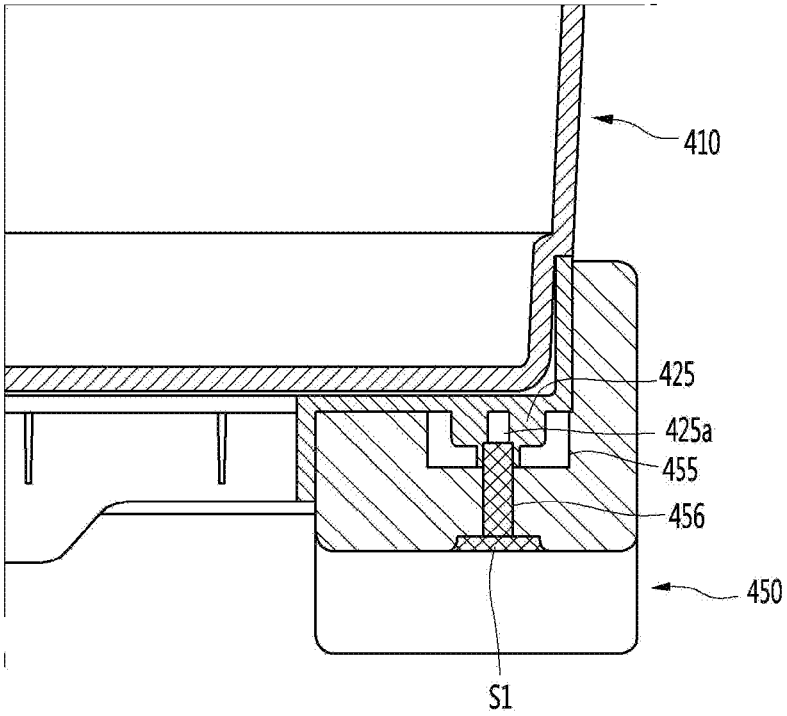
FIG. 11 is a cross-sectional view taken along line A-A of FIG. 7.
Figure 12:
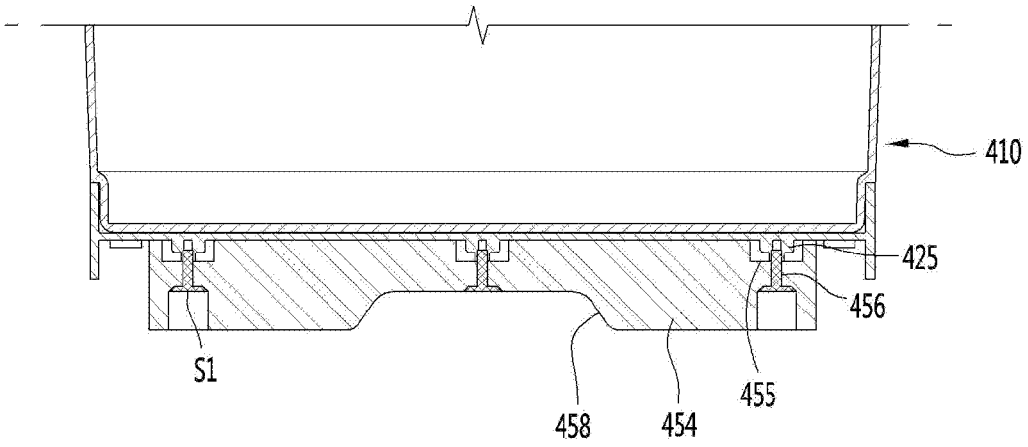
FIG. 12 is a cross-sectional view taken along line B-B of FIG. 7.
Figure 13:
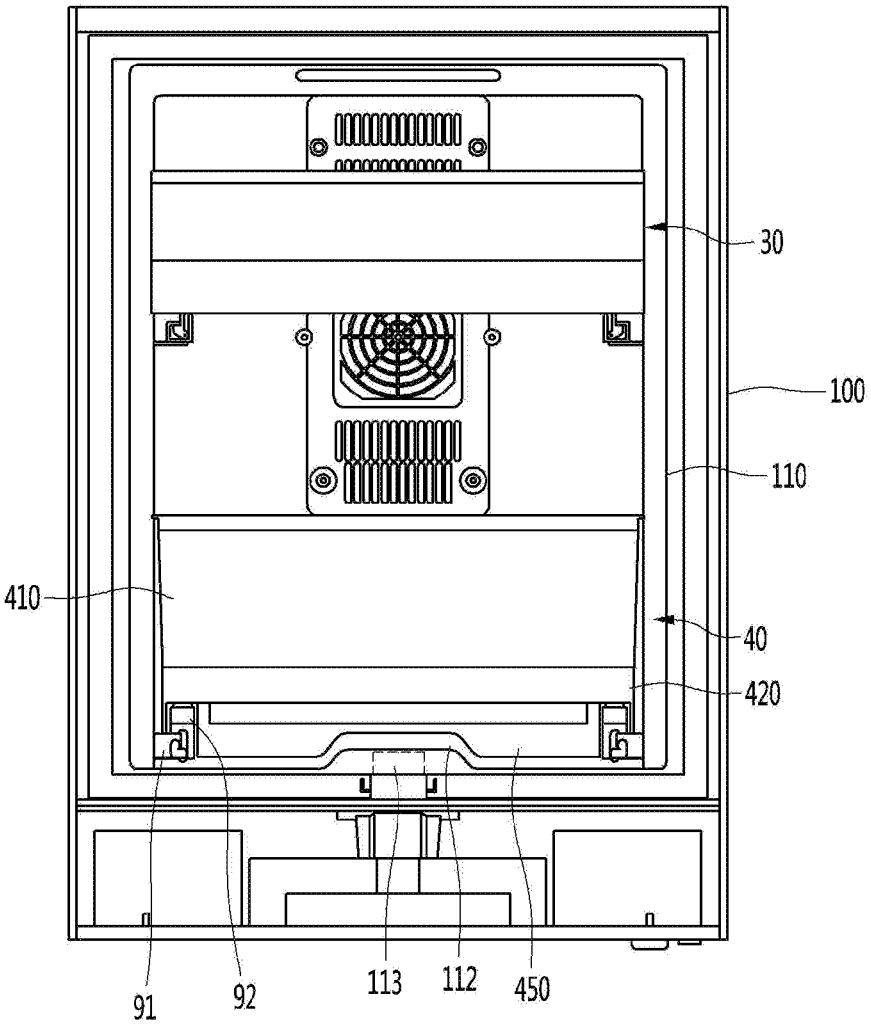
FIG. 13 is a front view of the cabinet showing in a state in which the drawer assembly is inserted into a storage chamber.

FIG. 11 is a cross-sectional view taken along line A-A of FIG. 7. FIG. 12 is a cross-sectional view taken along line B-B of FIG. 7. FIG. 13 is a front view of the cabinet showing in a state in which the drawer assembly is inserted into a storage chamber.

Referring to FIGS. 7 to 13, the lower drawer assembly 40 (hereinafter referred to as a drawer assembly) may include a drawer 410 forming a food storage space and a drawer supporter 420 supporting the drawer 410.

Further, the refrigerator 1 may include a weight balance 450 on the drawer assembly 40, which is provided opposite the door 20.

The drawer 410 may be made of a plastic injected material, and the drawer supporter 420 may be made of a metal material. The present disclosure is not limited to the above-described configuration.

The drawer 410 may include a drawer body 412. In one example, the drawer body 412 may be formed in a rectangular parallelepiped shape having a top surface opened.

The drawer body 412 may include a supporter-seated portion 414 that rests on the drawer supporter 420.

In one example, the supporter-seated portion 414 may be formed by a portion of the periphery of the lower portion of the drawer body 412 being stepped inwardly.

The drawer supporter 420 may include a drawer support body 421 of a rectangular frame shape. The supporter-seated portion 414 may be seated on the bottom surface 423 of the drawer support body 421.

The drawer support body 421 accommodates a portion of the drawer 410. For example, the supporter-seated portion 414 may be received in the drawer supporter 420. A top surface of the drawer supporter 420 may support a stepped portion 413 of the drawer body 412.

In order to reduce the weight of the drawer supporter 420, an opening 426 may be formed in the bottom surface 423 of the drawer supporter 420.

An extension 427 may be formed along the opening 426 of the bottom surface 423. The extension 427 extends downward from the bottom surface 423 and the extension 427 may be engaged with the horizontal frame 272 of the door bracket 270. In one example, the extension 427 may have an engagement hole 428 defined therein for engagement with the fastener.

Thus, the drawer supporter 420 is secured to the rear surface of the door 20 by a door bracket 270, whereby the drawer support 420 moves with the door 20.

Since the drawer 410 is seated on the drawer supporter 420, the drawer 410 moves together with the door 20 and the drawer supporter 420 in a state in which the drawer 410 is seated on the drawer supporter 420.

That is, when the user pulls the door 20, the drawer supporter 420 and the drawer 410 together may be pulled out of the storage chamber 111.

In a state in which the drawer 410 is drawn out of the storage chamber 111, the user may lift the drawer 410 upwards to separate the drawer 410 from the drawer supporter 420. Thus, the user can easily separate the drawer 410, and, then, the separated drawer 410 can be easily cleaned by the user.

The drawer supporter 420 may further include covering portions 424 extending downwardly respectively from both opposing ends of the drawer support body 421. The covering portion 424 is spaced apart from the extension 427. Thus, a space is formed between the covering portion 424 and the extension 427. Within the space, the rail assembly 90 and the horizontal bracket 272 may be located.

The covering portion 424 may cover the rail assembly 90. Thus, the covering portion 424 moves together with the drawer supporter 420 while the covering portion 424 covers the outside of the rail assembly 90. Thereby, the exposure of the rail assembly 90 to the outside may be minimized.

In one example, the rail assembly 90 may include both opposing fixed rails 91 fixed to the inner casing 110 and corresponding both opposing movable rails 92 movably respectively connected to the fixed rails 91.

Further, in a state in which the covering portion 424 is located above the fixed rail 91, the covering portion 424 may cover the side face of the movable rail 92.

The weight balance 450 may be coupled to the drawer supporter 420 and opposite the door 20 to prevent the center of the overall weight from biasing forwards relative to the drawer supporter 420. That is, the weight balance 450 may balance the weight along the front-rear direction relative to the drawer supporter 420.

However, in order to allow the weight along the front-rear direction of the drawer supporter 420 to approximately balance, the weight of the door 20 and the weight of the weight balance 450 need not be the same.

The weight balance 450 may include a first portion 452 that is positioned below the drawer supporter 420 and a second portion 454 that is positioned behind the drawer supporter 420 to ensure the weight of the weight balance 450.

At least one of the first portion 452 and the second portion 454 may be coupled to the drawer supporter 420. In FIG. 9, the first portion 452 is shown which is coupled to the drawer supporter 420.

The weight of the first portion 452 may become heavier than the weight of the second portion 454 in order that while the weight balance 450 prevents the center of weight from being biased forward relative to the drawer supporter 420, the weight center is lowered.

In addition, in order that within the limited space within the storage chamber 111, the weight balance 450 is prevented from interfering with surrounding structures, the volume of the first portion 452 may be greater than the volume of the second portion 454.

In order that while the weight balance 450 is coupled onto the drawer supporter 420, the weight balance 450 is prevented from interfering with the rail assembly 90, the horizontal length of the weight balance 450 may be smaller than the horizontal length of the drawer supporter 420. Further, both opposite edges of the weight balance 450 may be spaced apart from the covering portion 424 of the drawer supporter 420.

In one example, the weight balance 450 may be located between the both opposing covering portions 424. The movable rail 92 may be located between each covering portion 424 and the weight balance 450.

The horizontal length of the weight balance 450 may be longer than the spacing between the covering portion 424 and the weight balance 450.

The bottom surface of the first portion 452 of the weight balance 450 may be positioned lower than the bottom surface of the covering portion 424. However, the first portion 452 may be spaced apart from the bottom surface of the inner casing 110.

On the bottom surface of the inner casing 110, a protrusion 112 may be formed to protrude in the front-rear direction. The protrusion 112 provides a space where a door switch 113 for door opening detection is positioned.

The first portion 452 may include a grooved portion 458 to prevent interference with the protrusion 112. The grooved portion 458 may be recessed upwardly within the first portion 452.

<Coupling Structure Between Drawer Supporter and Weight Balance>

Referring to FIGS. 8, 11 and 12, one or more coupling protrusions 425 are projected on the bottom surface 423 of the drawer supporter 420. Correspondingly, on the weight balance 450, one or more protrusion receiving portions 455 may be provided to receive the one or more coupling protrusions 425.

For the rigid coupling between the weight balance 450 and the drawer supporter 420, the plurality of coupling protrusions 425 may be arranged on the drawer supporter 420 so as to be spaced apart from one another in the horizontal direction. Correspondingly, the plurality of protrusion receiving portions 455 may be arranged on the weight balance 450 so as be spaced apart from one another in the horizontal direction.

The protrusion receiving portion 455 may have an engagement hole 456 defined therein through which the fastener S1 passes. The engagement hole 456 may pass through the weight balance 450.

In one example, the engagement hole 456 may extend downward from the bottom of the protrusion receiving portion 455. The engagement hole 456 may then pass through the weight balance 450 in a vertical direction.

In the coupling protrusion 425, an engagement groove 425*a* for engaging with the fastener S1 may be formed.

For engagement between the weight balance 450 and the drawer supporter 420, the coupling protrusion 425 is received within the protrusion receiving portion 455 in a state in which the first portion 452 of the weight balance 450 is positioned below the drawer supporter 420.

The assembler then engages the fastener S1 into the engagement hole 456, from below the weight balance 450. The fastener S1 may pass through the engagement hole 456 and then may be finally engaged into the engagement groove 425*a* of the coupling protrusion 425.

According to the present disclosure, the weight balance prevents the center of gravity from being biased forward of the drawer supporter, so that the door can be stably opened.

In addition, during the process of withdrawing the drawer assembly together with the door, the refrigerator may be prevented from tilting forward or the door may be prevented from colliding against the bottom surface.

In addition, in a state in which the drawer is drawn out of the storage chamber, the user may separate the drawer from the drawer supporter. Therefore, the drawer can be easily separated, and the user can easily clean the separated drawer.

Furthermore, the covering portion is provided on the drawer supporter, and the covering portion covers the rail assembly. In this way, exposure of the rail assembly to the outside can be minimized in the process of drawing the drawer assembly to the outside.

What is claimed is:

1. A refrigerator comprising:

a cabinet that defines a storage chamber therein;

a door configured to open and close at least a portion of the storage chamber;

a drawer assembly having a first side that faces a rear of the cabinet and a second side that faces a front of the cabinet and that is connected to the door, the drawer assembly comprising a drawer and a drawer supporter that is coupled to the door and configured to support the drawer;

a rail assembly configured to slidably couple the drawer assembly to the cabinet; and a weight balance disposed at the first side of the drawer assembly, wherein the drawer supporter comprises a pair of covering portions that extend in a downward direction from a bottom side of the drawer supporter and that are configured to cover at least a portion of the rail assembly.

2. The refrigerator of claim 1, wherein the weight balance is positioned laterally between the pair of covering portions.

3. The refrigerator of claim 2, wherein a lateral width of the weight balance is greater than a lateral distance between one of the pair of covering portions and the weight balance.

4. The refrigerator of claim 2, wherein the weight balance is spaced apart from each of the pair of covering portions to thereby define a space configured to receive the at least portion of the rail assembly.

5. The refrigerator of claim 2, wherein the weight balance protrudes in the downward direction relative to a bottom surface of each of the pair of covering portions.

6. The refrigerator of claim 1, wherein the drawer comprises a drawer body, the drawer body comprising a supporter-seated portion disposed at a lower portion of the drawer and configured to be seated in the drawer supporter, wherein the drawer supporter comprises a drawer support body that has a rectangular frame shape and that is configured to receive the supporter-seated portion, and wherein the pair of covering portions respectively extend in the downward direction from lateral ends of the drawer support body.

7. The refrigerator of claim 6, wherein the drawer supporter has a bottom surface that defines an opening.

8. The refrigerator of claim 6, wherein the weight balance is coupled to the drawer supporter.

9. The refrigerator of claim 8, wherein the weight balance contacts a rear side of the drawer supporter and the bottom side of the drawer supporter.

10. The refrigerator of claim 6, wherein the supporter-seated portion is recessed inward from an outer surface of the drawer body and surrounds the lower portion of the drawer.

11. The refrigerator of claim 1, wherein the rail assembly comprises:

a fixed rail connected to the cabinet; and a movable rail connected to the drawer supporter and slidably coupled to the fixed rail, the drawer assembly being configured to, based on movement of the moving rail relative to the fixed rail, slidably insert into and withdraw from the storage chamber, and wherein each of the pair of covering portions is configured to cover the movable rail.

12. The refrigerator of claim 11, wherein the movable rail is positioned laterally between one of the pair of covering portions and the weight balance.

13. The refrigerator of claim 1, wherein the drawer assembly is configured to slidably insert into and withdraw from the storage chamber in a state in which the door and the drawer assembly are connected to each other.

14. The refrigerator of claim 1, wherein the drawer is configured to be removably seated on the drawer supporter.

15. The refrigerator of claim 1, wherein the pair of covering portions are spaced apart from each other in a lateral direction and extend in the downward direction from opposing edges of the bottom side of the drawer supporter.

16. The refrigerator of claim 1, wherein the weight balance is disposed rearward relative to rear ends of the pair of covering portions.

17. The refrigerator of claim 1, wherein the drawer supporter further comprises a coupling protrusion that protrudes from the bottom side of the drawer supporter in the downward direction, and wherein the weight balance defines a protrusion receiving portion recessed from a top surface of the weight balance and configured to accommodate the coupling protrusion of the drawer supporter.

18. The refrigerator of claim 17, wherein the weight balance defines an engagement hole that is configured to receive a fastener configured to couple to the coupling protrusion through the protrusion receiving portion.

19. The refrigerator of claim 1, wherein the door comprises:

a door liner that defines a rear surface of the door and that faces the drawer assembly; and a door frame that extends rearward from the door liner and that is configured to support the drawer supporter.

20. The refrigerator of claim 19, wherein the door frame comprises:

a vertical frame that is coupled to the door liner and that extends along the door liner; and a horizontal frame that extends rearward from the vertical frame toward the drawer assembly and that is configured to couple to the bottom side of the drawer supporter.

* * * * *